US007350515B2

(12) United States Patent
Yao et al.

(10) Patent No.: US 7,350,515 B2
(45) Date of Patent: Apr. 1, 2008

(54) BALL FEEDER FOR BALL SERVING MACHINE

(75) Inventors: Lin Zhan Yao, ShenZhen (CN); Ze Jun Li, ShenZhen (CN)

(73) Assignee: Long Way Enterprise Co., Ltd., Taipei (TW)

( * ) Notice: Subject to any disclaimer, the term of this patent is extended or adjusted under 35 U.S.C. 154(b) by 0 days.

(21) Appl. No.: 11/318,834

(22) Filed: Dec. 28, 2005

(65) Prior Publication Data

US 2006/0169261 A1 Aug. 3, 2006

(30) Foreign Application Priority Data

Jan. 28, 2005 (TW) ..... 94201593 U

(51) Int. Cl.
*F41B 4/00* (2006.01)

(52) U.S. Cl. ..... 124/51.1; 124/49

(58) Field of Classification Search ..... 124/45, 124/48, 49, 50, 51.1; 193/12; 473/451
See application file for complete search history.

(56) References Cited

U.S. PATENT DOCUMENTS 3,459,168 A * 8/1969 Bruce ..... 124/78
3,570,466 A * 3/1971 White et al. ..... 124/54
4,132,214 A * 1/1979 Schnurr et al. ..... 124/1
4,185,608 A * 1/1980 Young et al. ..... 124/16
4,360,204 A * 11/1982 Karr ..... 473/137
4,578,291 A * 3/1986 Miner ..... 428/8
4,676,504 A * 6/1987 Ponza ..... 124/7
4,896,646 A * 1/1990 Kahelin et al. ..... 124/51.1
6,176,230 B1 * 1/2001 Thompson ..... 124/16
6,190,271 B1 * 2/2001 Rappaport et al. ..... 473/451

* cited by examiner

*Primary Examiner*—John A. Ricci
(74) *Attorney, Agent, or Firm*—Rabin & Berdo, PC

(57) ABSTRACT

A ball feeder for ball serving machine includes a seat consisting of a hollow transfer frame and a shaft bear, a rotating unit mounted to one side of the seat and having a ball scoop extended from an end thereof, and a plurality of guide sections sequentially rotatably connected at an end to the shaft bearing. The guide sections may be turned about the shaft bearing in the same direction to form a nonlinearly inclined spiral ball guide path. A ball put in the top guide section automatically rolls down along the ball guide path and falls into the transfer frame to be caught by the ball scoop. When the ball scoop is turned by the rotating unit to face downward, the ball on the ball scoop falls into a feeding mouth on a body of the ball serving machine and is automatically served.

4 Claims, 6 Drawing Sheets

BALL FEEDER FOR BALL SERVING MACHINE

FIELD OF THE INVENTION

The present invention relates to a ball feeder for ball serving machine, and more particularly to a ball feeder for ball serving machine in which a plurality of guide sections may be developed from a folded state into a spiral ball guide path, along which a ball is sent to a feeding mouth on the ball serving machine and automatically served. With the foldable guide sections, the ball feeder may have reduced volume for easy storage and transport.

BACKGROUND OF THE INVENTION

Various kinds of products in connection with ball games, including baseball, table tennis, tennis, etc., have been developed and are available in the market. Most of the ball games require special sporting equipment, place, and fixed number of players. Thus, many ball-game players and lovers have to use practicing instruments to develop their skill. A ball serving machine is one example of such practicing instruments. With the ball serving machine, ball-game players and lovers may train themselves in a place with limited space.

The ball serving machine is generally used along with a ball feeder. A user puts balls in the ball feeder, which feeds the balls to the ball serving machine for automatic serving.

Most of the conventional ball feeders for use with the ball serving machine include a metal-made long ball path, and a motor and an elastic wheel to drive the balls forward, and are therefore bulky and heavy to cause difficulties in packaging and transporting them. Balls driven to move forward by the motor and the elastic wheel in the conventional ball feeder tend to skid or be stuck in the ball path. Moreover, the conventional ball feeders usually have complicate structure and are inconvenient to assemble and transport, and require considerably large space for storage. Therefore, it is desirable to develop a ball feeder for ball serving machine that can be conveniently stored and transported and is really useful in helping ball-game players and lovers to improve their skill.

SUMMARY OF THE INVENTION

A primary object of the present invention is to provide a ball feeder for ball serving machine in which a plurality of foldable guide sections may be developed into a spiral ball guide path that facilitates easy guiding of balls to the ball serving machine and occupies a reduced space.

Another object of the present invention is to provide a ball feeder for ball serving machine that includes a plurality of easily foldable guide sections to largely reduce the volume and weight of the ball feeder and accordingly enable easy storage and transport of the ball feeder.

A further object of the present invention is to provide a ball feeder for ball serving machine that includes a ball scoop controlled by a rotating unit to rotate at fixed speed for catching and indirectly sending a ball to the ball serving machine for automatic serving.

A still further object of the present invention is to provide a ball feeder for ball serving machine that includes a rotating unit to control the rotating speed of a ball scoop, so that a ball fallen onto the ball scoop is fed to the ball serving machine at a controlled speed to facilitate good control of a serving rate of the ball serving machine.

To achieve the above and other objects, the ball feeder for ball serving machine according to the present invention includes a seat consisting of a hollow transfer frame and a shaft bear, a rotating unit mounted to one side of the seat and having a ball scoop extended from an end thereof, and a plurality of guide sections sequentially connected at an end to the shaft bearing. A stopper is movably mounted to an outer end of a top one of the guide sections to stop a ball from rolling out of a nonlinearly inclined spiral ball guide path formed by developing the guide sections in the same direction.

In the present invention, an opening is provided on a wall of the transfer frame at a position corresponding to the rotating unit, so that the ball scoop may be extended into the transfer frame via the opening to contact with an inner wall surface of the transfer frame.

The rotating unit may be a motor or an electromagnetic valve for controlling the rotating speed of the ball scoop.

When it is desired to use the ball feeder of the present invention, simply develop the folded guide sections in the same direction to form the spiral ball guide path, and a ball put in the top guide section automatically rolls down along the ball guide path and falls into the transfer frame of the seat to be caught by the ball scoop. The rotating unit controls the ball scoop to rotate in a circular motion at a fixed speed. When the ball scoop is turned to face downward, the ball sat thereon is then allowed to fall into a feeding mouth on a body of the ball serving machine and be automatically served.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
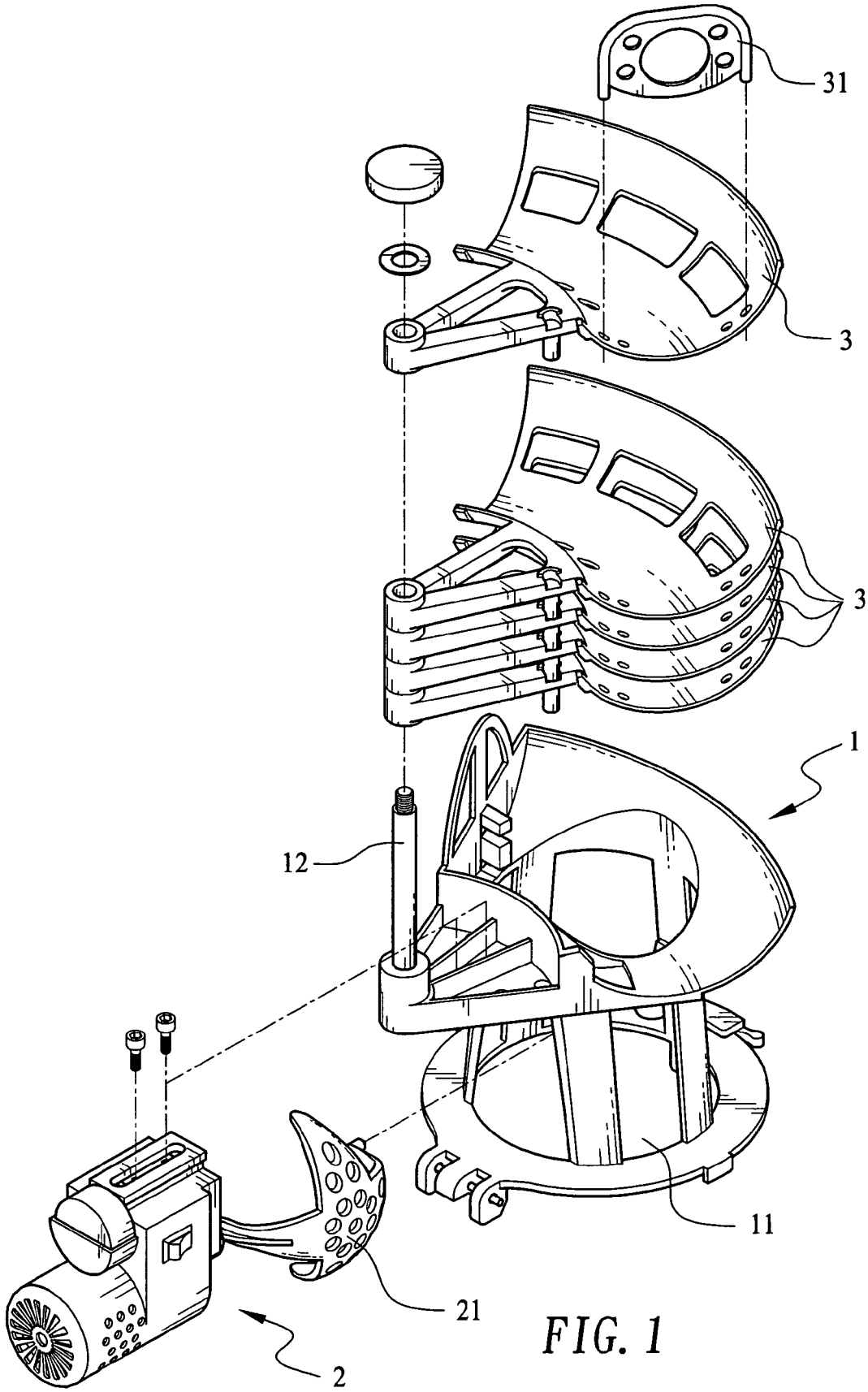
FIG. 1 is an exploded perspective view of a ball feeder for ball serving machine according to a preferred embodiment of the present invention.
Figure 2:
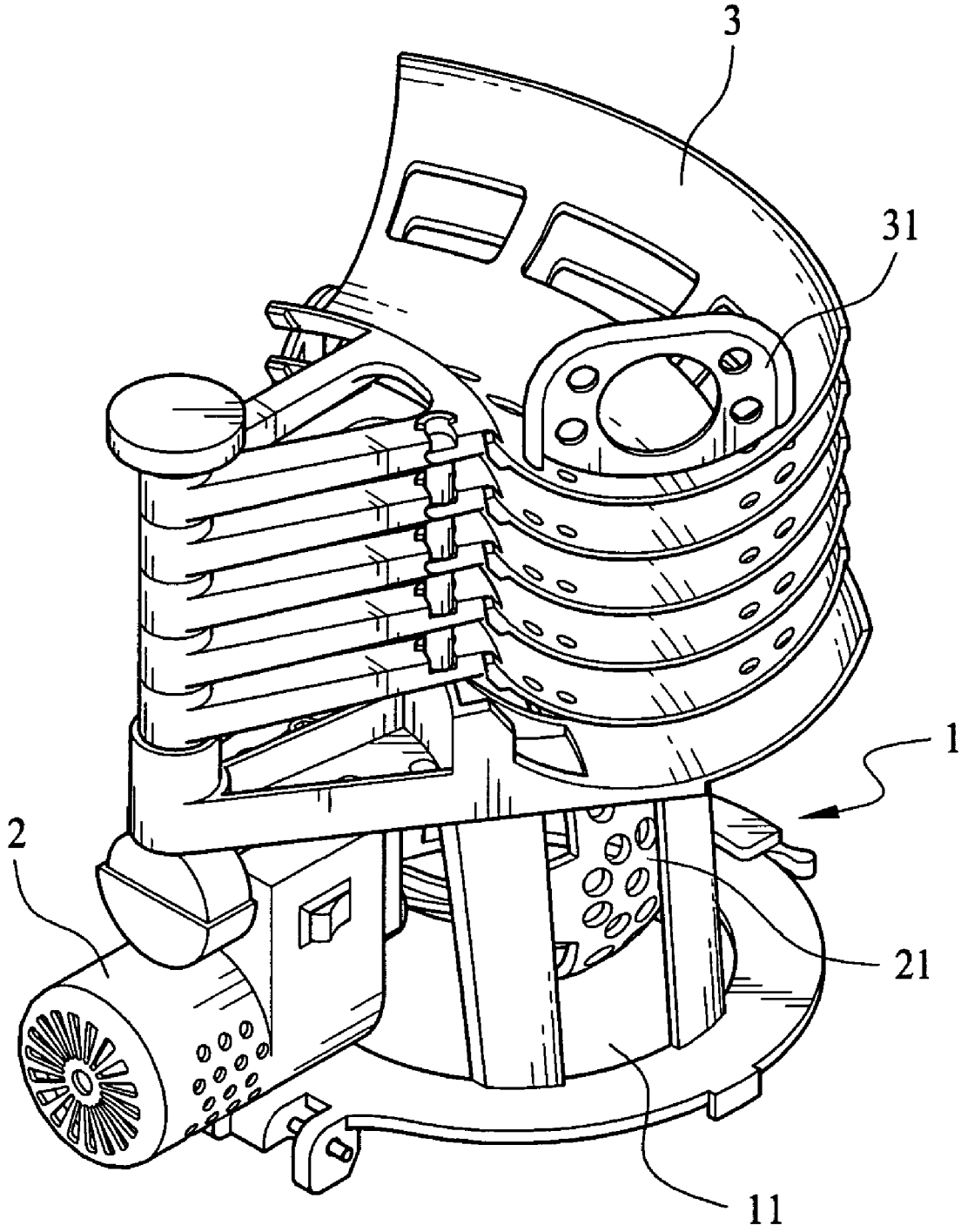
FIG. 2 is an assembled perspective view of the ball feeder of FIG. 1 in a folded state.

Please refer to FIGS. 1 and 2 that are exploded and assembled perspective views, respectively, of a ball feeder for ball serving machine according to a preferred embodiment of the present invention.

As shown, the ball feeder for ball serving machine according to the present invention includes a seat 1 consisting of a hollow transfer frame 11 and a shaft bearing 12; a rotating unit 2 mounted to one side of the seat 1 and having a ball scoop 21 extended from an end of the rotating unit 2; and a plurality of guide sections 3 sequentially rotatably connected at an end to the shaft bearing 12 for forming a ball guide path.

The ball scoop 21 extended from the rotating unit 2 is located in the hollow transfer frame 11 of the seat 1 to contact with an inner wall surface of the transfer frame 11.

The rotating unit 2 is a motor or an electromagnetic valve for controlling a rotating speed of the ball scoop 21. A stopper 31 is movably connected to an outer end of a top guide section 3 for stopping a ball 5 from rolling out of an upper end of the ball guide path.

Figure 3:
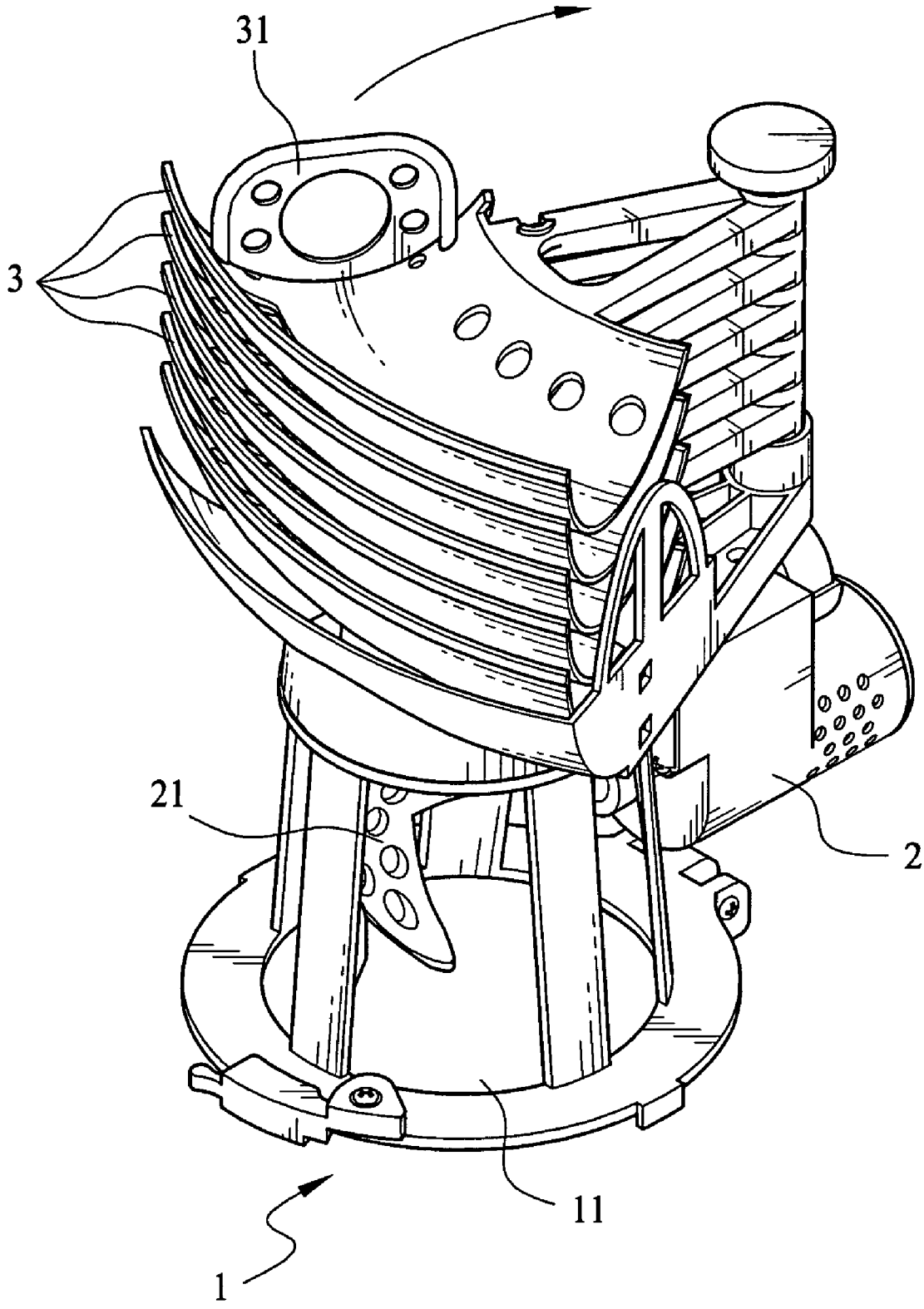
FIG. 3 shows the manner of developing the folded ball feeder of FIG. 2.
Figure 4:
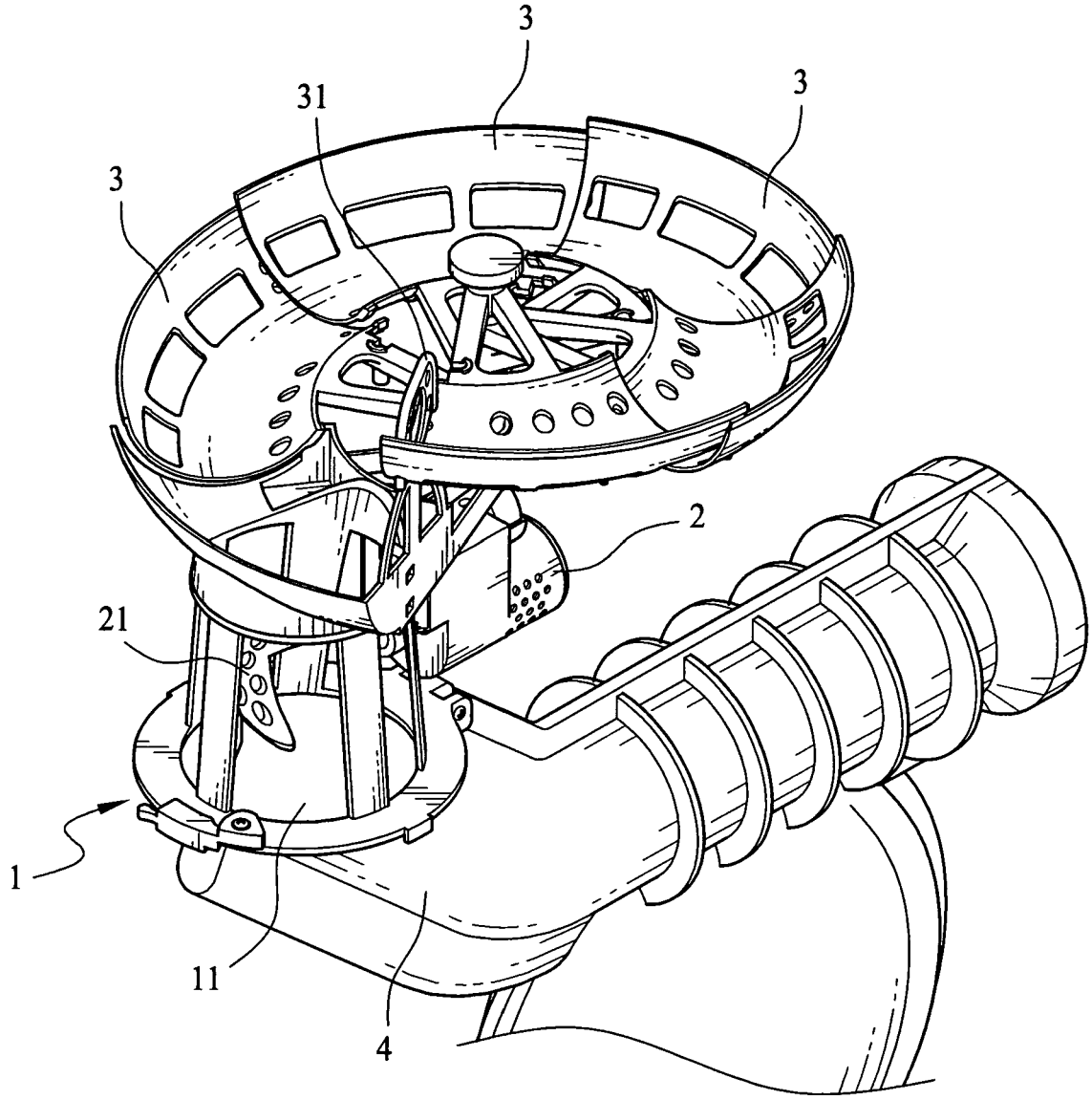
FIG. 4 shows the ball feeder of FIG. 2 in a developed state and mounted to a ball serving machine.

FIGS. 3 and 4 show the manner of developing the guide sections 3 to form the ball guide path. When it is desired to use the ball feeder of the present invention, first mount the seat 1 to a ball serving machine 4 for the seat 1 to firmly connect to the ball serving machine 4. Then, turn the guide sections 3 about the shaft bearing 12 in the same direction, so that the guide sections 3 are fully developed to form a nonlinearly inclined spiral ball guide path, along which balls 5 roll down and are collected in the transfer frame 11 of the seat 1.

Figure 5:
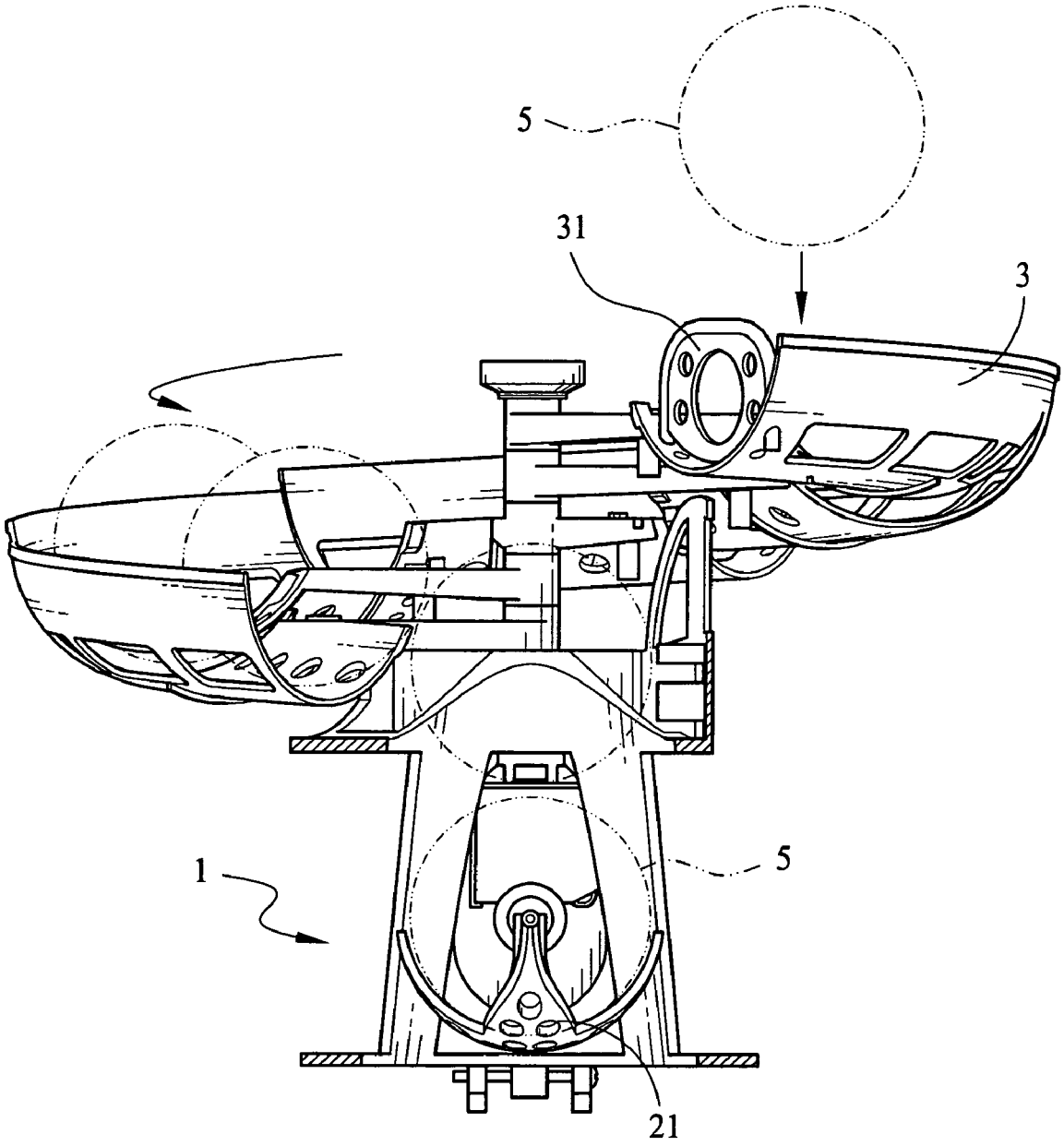
FIGS. 5 and 6 show how the ball feeder of FIG. 2 works to feed a ball to the ball serving machine.
Figure 6:
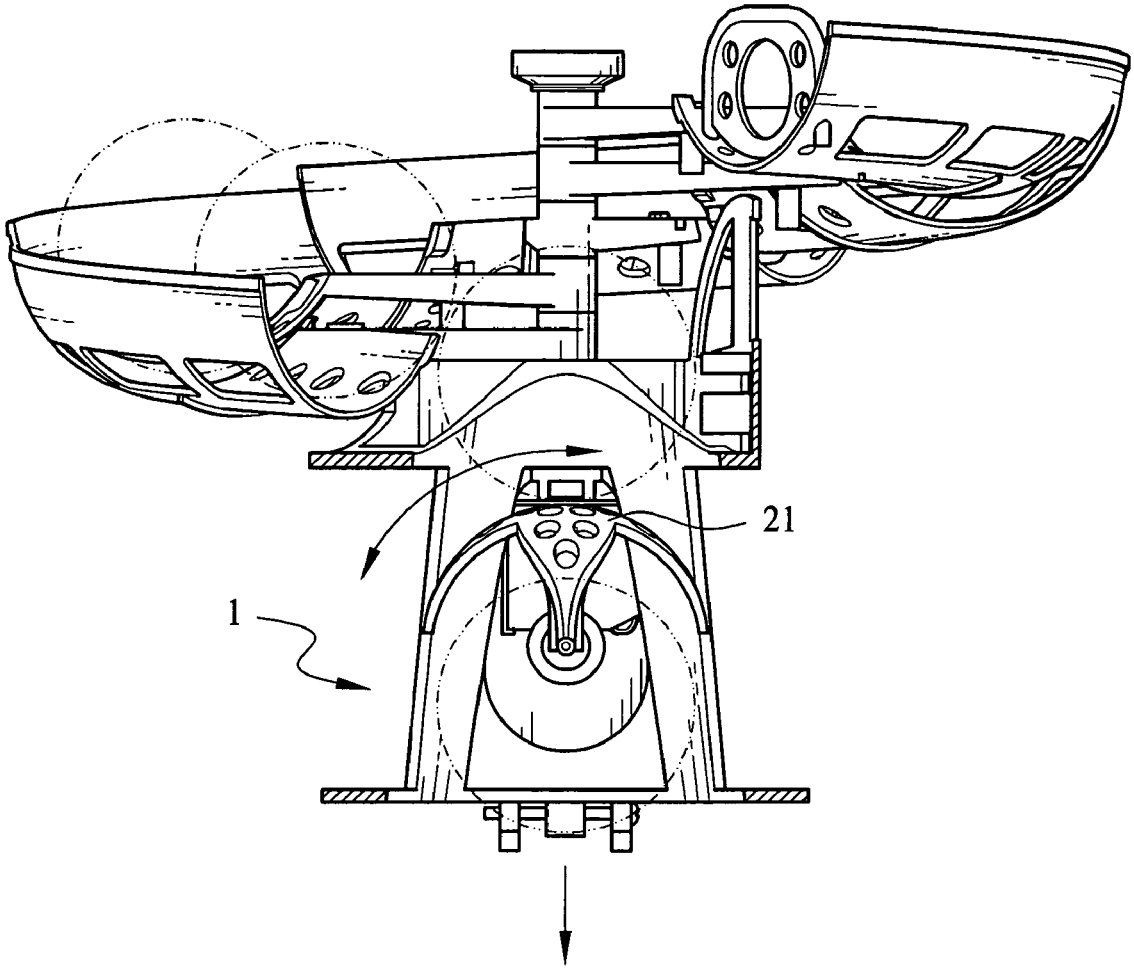

Please refer to FIGS. 5 and 6. When a ball 5 is put on the top guide section 3, the ball 5 automatically rolls down along the ball guide path formed from the guide sections 3 to reach a top of the seat 1 and fall into the transfer frame 11 to be caught by the ball scoop 21. With the rotating unit 2, the ball scoop 21 is controlled to rotate in a circular motion at a fixed speed or rhythm. When the ball scoop 21 is turned to face downward in the transfer frame 11, the ball 5 sat thereon is then allowed to fall into a feeding mouth on a body of the ball serving machine 4 and be automatically served.

In the ball feeder of the present invention, a spiral ball guide path is formed by developing a plurality of guide sections 3 to facilitate easy collecting and guiding of multiple balls 5 to the ball serving machine 4 for automatic serving, making the ball feeder of the present invention easy to operate and convenient for use. Since the developed guide sections 3 are spirally extended in an upward direction, the ball guide path so formed occupies a largely reduced space. Meanwhile, with the ball scoop 21, the ball 5 would not directly fall from the ball guide path into the body of the ball serving machine 4. Moreover, with the rotating unit 2 that controls the rotating speed of the ball scoop 21, it is easier to control a serving rate of the ball serving machine 4. Since the ball feeder of the present invention is quickly foldable, it has largely reduced volume and weight to enable easy storage and transport thereof.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A ball feeder for a ball serving machine, comprising:

a seat including a hollow transfer frame positionable over the ball serving machine, the hollow transfer frame having an upper and a lower opening, the seat further having an upright shaft bearing adjacent to the hollow transfer frame;

a rotating unit mounted to one side of said seat and having a ball scoop extended from one end of said rotating unit and into said hollow transfer frame, said ball scoop being caused to rotate by said rotating unit to a first position in which said ball scoop blocks the upper opening of the transfer frame, and to a second position in which said ball scoop blocks the lower opening of the transfer frame; and a plurality of guide sections sequentially and telescopically connected together, each guide section being rotatably connected to said shaft bearing, said guide sections being rotatable to a first position in which said guide sections are disposed superposed over each other, and to a second position in which said guide sections collectively form an inclined spiral groove that terminates above the upper opening of the transfer frame;

wherein when a ball is deposited in the spiral groove, the ball rolls down the spiral groove toward the upper opening of the transfer frame, wherein when the ball scoop blocks the upper opening of the transfer frame, the ball is prevented from falling into the transfer frame, wherein when the ball scoop blocks the lower opening of the transfer frame, the ball can fall from the spiral groove into the transfer frame, and wherein when the ball scoop rotates to the first position when the ball is in the transfer frame, the ball in the transfer frame falls into the ball serving maching.

2. The ball feeder for ball serving machine as claimed in claim 1, wherein said ball scoop is located in said transfer frame of said seat to contact with an inner wall surface of said transfer frame.

3. The ball feeder for a ball serving machine as claimed in claim 1, wherein said rotating unit comprises a motor.

4. The ball feeder for ball serving machine as claimed in claim 1, further comprising a stopper movably connected to an outer end of a top one of said guide sections.

* * * * *